US006745830B2

(12) United States Patent
Dinh

(10) Patent No.: US 6,745,830 B2
(45) Date of Patent: Jun. 8, 2004

(54) HEAT PIPE LOOP WITH PUMP ASSISTANCE

(75) Inventor: Khanh Dinh, 7819 NW. 22 La., Gainesville, FL (US) 32605

(73) Assignee: Khanh Dinh, Gainesville, FL (US)

( * ) Notice: Subject to any disclaimer, the term of this patent is extended or adjusted under 35 U.S.C. 154(b) by 0 days.

(21) Appl. No.: 10/348,816

(22) Filed: Jan. 22, 2003

(65) Prior Publication Data

US 2003/0136555 A1 Jul. 24, 2003

Related U.S. Application Data

(60) Provisional application No. 60/351,060, filed on Jan. 22, 2002.

(51) Int. Cl.[7] ..... F28F 27/00
(52) U.S. Cl. ..... 165/274; 165/104.25
(58) Field of Search ..... 165/104.33, 104.25, 165/104.21, 104.14, 104.26, 104.24

(56) References Cited

U.S. PATENT DOCUMENTS 1,679,489 A * 8/1928 Page et al. ..... 165/104.25
4,240,268 A * 12/1980 Yuan ..... 165/104.25
4,745,965 A 5/1988 Katsura et al.
4,750,543 A 6/1988 Edelstein
5,802,862 A 9/1998 Eiermann ..... 62/173
5,911,272 A * 6/1999 Cornog et al. ..... 165/104.25

FOREIGN PATENT DOCUMENTS

JP 0207790 * 12/1982 ..... 165/104.14
JP 405248777 * 9/1993 ..... 165/104.24

* cited by examiner

*Primary Examiner*—Christopher Atkinson
(74) *Attorney, Agent, or Firm*—Kinney & Lange, P.A.

(57) ABSTRACT

A heat pipe loop includes a first heat pipe section having a first temperature and a second heat pipe section having a second temperature higher than the first temperature. The first heat pipe section is a condenser and the second heat pipe section is an evaporator. A vapor line connects an upper portion of the first heat pipe section with an upper portion of the second heat pipe section. A liquid line connects a lower portion of the first heat pipe section with a lower portion of the second heat pipe section. In one embodiment, the first heat pipe section is disposed at a first elevation and the second heat pipe section is disposed at a second elevation higher than the first elevation. A pump directs liquid from the first heat pipe section to the second heat pipe section through the liquid line.

13 Claims, 4 Drawing Sheets

HEAT PIPE LOOP WITH PUMP ASSISTANCE

CROSS-REFERENCE TO RELATED APPLICATION

This application claims the priority benefits of U.S. Provisional Patent Application Serial No. 60/351,060, filed Jan. 22, 2002, for "Heat Pipe Loop with Pump Assistance" by Khanh Dinh.

BACKGROUND OF THE INVENTION

Heat pipe heat exchangers are well known in the field of heat recovery and dehumidification. Heat pipes rely on a phase change process to absorb heat by evaporation and release heat by condensation, transferring large amounts of heat energy with very little difference in temperature.

Heat pipes typically comprise a condenser and an evaporator connected to each other in a closed system. The typical heat pipe comprises an enclosed tube system having one end forming an evaporator portion and having another, somewhat-cooler and lower-pressure end forming a condenser portion.

In use, liquid refrigerant present in the evaporator portion is heated by the environment, vaporized, and rises into the condenser portion. In the condenser portion, the refrigerant is cooled by the environment, is condensed with the release of heat, and is then returned to the evaporator portion. The cycle then repeats itself, resulting in a continuous cycle in which heat is absorbed from the environment by the evaporator and released by the condenser.

Heat pipe heat exchangers are generally made into two sections that are inserted, each in one of two air streams, where there is a temperature differential between the two air streams. The air streams are preferably in close proximity to each other and preferably flow in opposite directions. The flow of the refrigerant in heat pipes can be induced by passive techniques such as gravity flow, capillary action, thermal pumping, and thermo-syphoning. Such passive techniques have dimensional restrictions, and work better in relatively small heat pipes. Thus, there is a need for a design which works well for larger scale heat pipes, and for heat pipes that transfer heat between a hot source or air stream located higher than the cold source.

BRIEF SUMMARY OF THE INVENTION

A heat pipe loop includes a first heat pipe section having a first temperature and a second heat pipe section having a second temperature higher than, the first temperature. The first heat pipe section is a condenser and the second heat pipe section is an evaporator. A vapor line connects an upper portion of the first heat pipe section with an upper portion of the second heat pipe section. A liquid line connects a lower portion of the first heat pipe section with a lower portion of the second heat pipe section. In one embodiment, the first heat pipe section is disposed at a first elevation and the second heat pipe section is disposed at a second elevation higher than the first elevation. A pump directs liquid from the first heat pipe section to the second heat pipe section through the liquid line.

DETAILED DESCRIPTION

Figure 1:
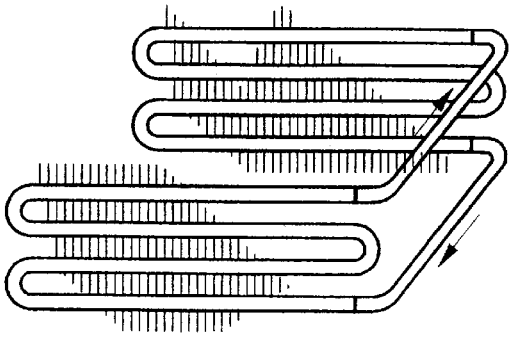
Fig 1 Prior Art
FIG. 1 is an illustration of a serpentine heat pipe of the prior art.

The present invention uses one or more pumps to forcefully pump a working fluid such as refrigerant within a heat pipe to facilitate heat transfer. It is especially applicable to larger scale heat pipes and heat pipes that transfer heat between a hot source or air stream located at the same level as or higher than the cold source. There are two basic configurations: one way pump assistance, two way pump assistance, and two variations on liquid distribution: flooding and spraying of the evaporator section. FIG. 1 is an illustration of a serpentine heat pipe of the prior art. It is well known in the prior art that loop heat-pipes operate efficiently, are easy to manufacture, and can be very cost effective in such applications as taught in U.S. Pat. No. 5,845,702, by Khanh Dinh, entitled "Serpentine Heat Pipe and Dehumidification Application in Air Conditioning Systems," incorporated herein by reference.

Figure 2:
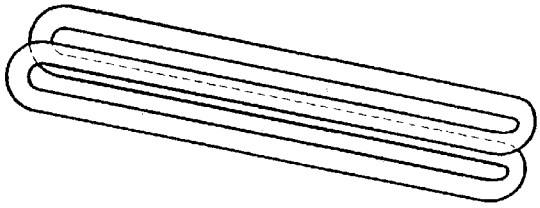
Fig 2 Prior Art
FIG. 2 is an illustration of a 3-D heat pipe of the prior art.

FIG. 2 is an illustration of a 3-D heat pipe of the prior art, described in U.S. Pat. No. 5,921,315 by Khanh Dinh, entitled "Three-Dimensional Heat Pipe," hereby incorporated by reference.

The traditional configuration of a heat pipe system is that the "hot" section or the section in the hot air stream must be placed lower than the "cold" section. The terms "hot" and "cold" are relative; in comparing the sections, the one with the higher temperature is referred to as the "hot" section, and the one with the lower temperature is referred to as the "cold" section, though the sections may not be hot or cold to the touch.

In the hot section, the working fluid inside the heat pipe vaporizes, and the vapor rises to the cold section, where it condenses and returns to the lower section by gravity. This cycle repeats as long as the lower section is hotter than the upper section. The working fluid is any liquid that is capable of evaporation and condensation and/is typically a liquid such as water, acetone, alcohol, glycol, or a refrigerant such as freon.

However, in some cases, the lower section is colder than the upper section. In this case, the liquid vaporizes in the upper section, condenses, and falls to the lower section. Because the lower section is cold, the liquid therein does not vaporize and instead accumulates in the cold lower section, thereby stopping the repeated process of transferring heat. Additionally, the efficiency of these designs diminishes as the heat pipes become larger. With the new pumped heat pipe loop, much larger scale heat pipes can be built with no loss of efficiency.

Figure 3:
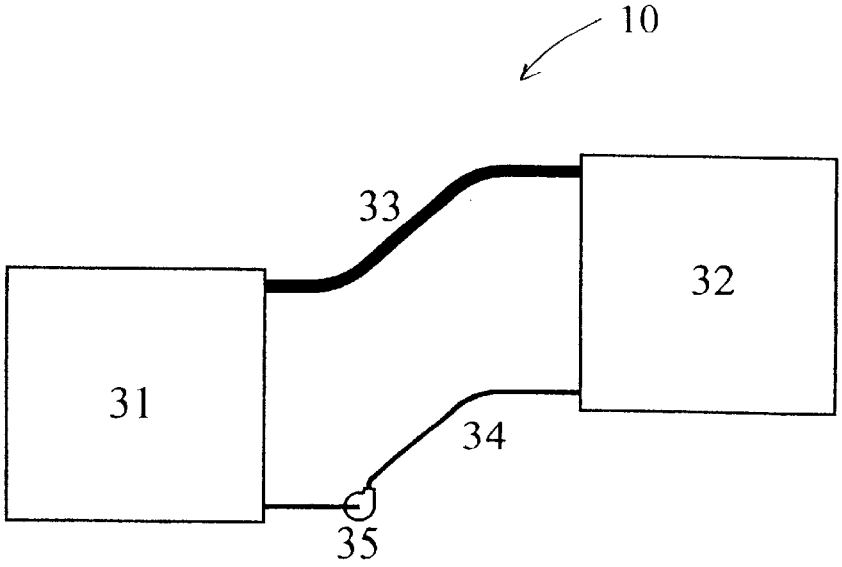
FIG. 3 is a side-view diagram of a one-way pump assisted heat pipe loop.

FIG. 3 is a diagram of a one-way pump assisted heat pipe loop. Heat pipe loop 10 typically consists of two sections, 31 and 32, that are connected by vapor line(s) 33 connecting an upper portion of the sections 31 and 32 and liquid line(s) 34 connecting a lower portion of sections 31 and 32. A typical application for such a heat pipe loop is for ventilation heat recovery for a large building, such as a hospital that needs a large amount of fresh air. In this example, the outgoing air stream is located higher than the incoming air stream. In the summer, when indoor air is cooler than outdoor air, lower section 31 will be hotter and upper section 32 will be cooler. Hot air will vaporize the liquid in lower section 31, which acts as an evaporator; the vapors will rise to upper section 32, which, acts as a condenser, condense into liquid, and return by gravity to lower section 31. The cycle will repeat continuously for as long as there is a difference of temperature.

In winter however, the temperature gradient is reversed. The outgoing air stream is hotter than the incoming air stream. Thus, lower section 31 will be cooler and upper section 32 will be hotter. The vapors will condense into liquid and accumulate in the lower section 31 which now acts as the condenser, and all heat transfer will stop unless the liquid is returned to the top. Pump 35 operates to pump the liquid back to hotter upper section 32, which now acts as the evaporator, where it will vaporize, allowing the heat pipe cycle to continue and heat to be transferred. Pump 35 may be any known apparatus or mechanism for pumping liquid. The construction of heat pipe loop 10 is accomplished through methods and products known in the art, such as by weldments to attach the components of heat pipe loop 10 to each other.

With the phase change process that heat pipes use to transfer heat, the fluid will evaporate and recondense even with very little temperature difference between the hot section and the cold section. With heat pipes, heat transfer occurs even when temperatures of the hot and cold sections are within about 5° F. of each other. When the heat pipe is designed with a very low pressure drop, heat transfer occurs even with temperature differentials as little as about 3° F. or even less than about 1° F. Without such a phase change, a greater temperature difference is required in order to transfer heat. Moreover, the use of a phase change process allows for the transfer of heat using very little working fluid. To accomplish the same amount of heat transfer without a phase change would require many times the amount of fluid.

One-way pump assistance is used to pump the liquid back to the higher hot section, where it can vaporize and continue to transfer heat. The pump will turn on only when the heat transfer is reversed, meaning when the higher section becomes hotter than the lower section. This occurs, for example, in air-to-air ventilation heat recovery applications operating both in summer and winter, where the hot and cold sections reverse as the seasons change. As one example, if Freon-22 is used as the working fluid in heat pipe loop 10, one pound of Freon-22 evaporating in the hot section and recondensing in the cold section transfers about 70 BTUs of heat.

Figure 4:
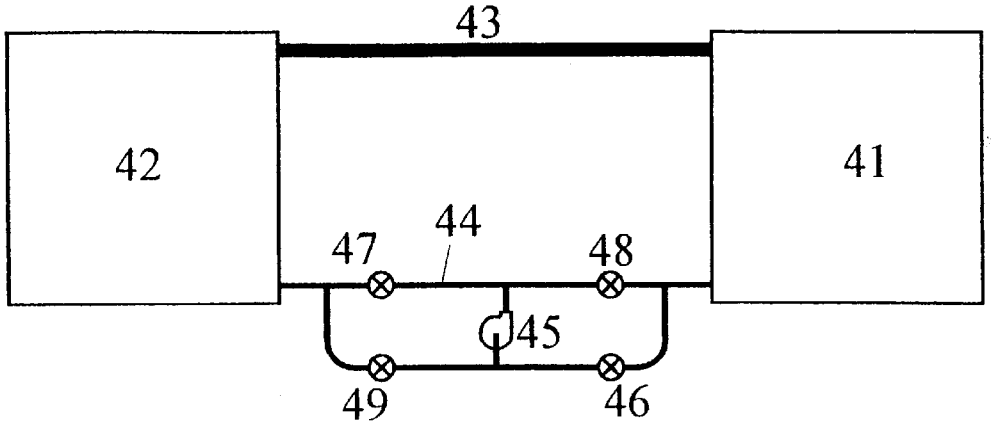
FIG. 4 is a side-view diagram of a two-way pump assisted heat pipe loop, using a single pump.

FIG. 4 is a diagram of a two-way pump assisted heat pipe loop, using a single pump. The two way pump assisted configuration is used when the two sections are at the same level-or about the same level and/or are separated by large distances. Where the hot and cold heat pipe sections are separated by a large distance, a pump can be used to assist in liquid; circulation by overcoming piping resistance. Such resistance to liquid and vapor circulation can be the result of such factors as friction due to the length of the pipes or traps due to the configuration of the pipes, e.g. pipes running up and down and turning. Use of a pump can allow for more flexibility in the design of piping without concerns of decreased efficiency.

When the hot and cold sections are at the same level or about the same level, the liquid at rest tends to be at the same level in both sections. In principle, as much as possible, the hot section of the heat pipe should be filled with liquid and the cold section with vapor. This provides maximum vaporization on the hot section and maximum vapor condensation in the cold section. The purpose of the pump or pumps is to circulate the liquid and to push the liquid level up to fill up the hot section and leave the cold section as empty of liquid as possible. More than one pump can be used, with or without control valves, and more than one heat pipe circuit can be used to obtain a counter-flow heat transfer effect.

FIG. 4 shows a two way pump assisted heat pipe loop with one pump. The heat pipe loop consists of two sections 41 and 42 connected by vapor line 43 and liquid line 44. Sections 41 and 42 are located at the same or nearly the same horizontal level. Theoretically, the liquid should distribute evenly between the two sections. But in reality, with pipe friction, distance, and other factors, the liquid has a tendency to accumulate in the cold section, and circulation will be minimal, thereby decreasing heat transfer. In this embodiment, a single pump 45 is used in conjunction with control valves to send the liquid to the hot section, where it can vaporize. The vapors will migrate by vapor pressure difference toward the cold section, where they will condense.

In this example, pump 45 pumps in a single direction. To achieve bidirectional pumping, two feed lines are provided. If 42 is the cold section where liquid is accumulated, the valves 46 and 47 will close and the pump will pump liquid from the cold section 42 to the hot section 41 through the opened valves 49 and 48. When temperatures reverse, for instance with a change of seasons, section 41 becomes the cold section and the flow of the pump is reversed by the closing of valves 48 and 49 and the opening of valves 46 and 47 to pump liquid from section 41 to the hot section 42. Therefore, the valve system allows pumping through only one of the two feed lines at a time.

Figure 5:
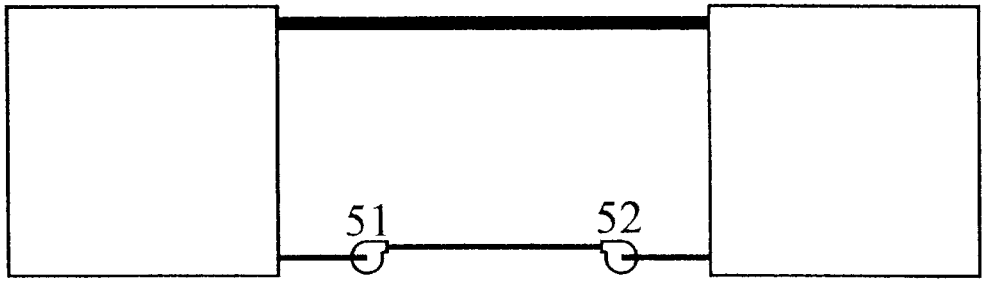
FIG. 5 is a side-view diagram of a two-way pump assisted heat pipe loop, using two pumps.

FIG. 5 is a diagram of a two-way pump assisted heat pipe loop, using two pumps 51 and 52. In this configuration, only one pump operates at any time, depending on the season or other factors. The pumps can be of a centrifugal type or another type that allows free back flow in the pump which is not operating.

Figure 6:
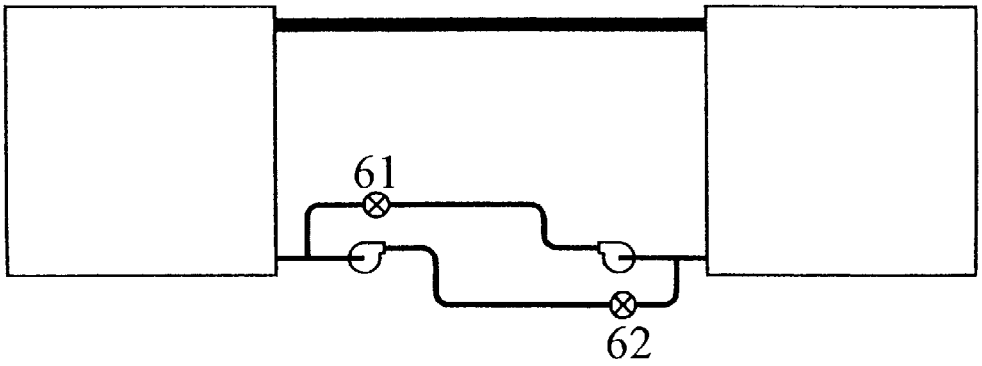
FIG. 6 is a side-view diagram of a two-way pump assisted heat pipe loop, using two pumps and bypass valves.

FIG. 6 is a diagram of a two-way pump assisted heat pipe loop, using two pumps and bypass valves. This configuration is useful when the selected pumps do not allow back flow when not in operation. In that case, either valve 61 or 62 can be closed to bypass the obstruction created by the pump not in operation. Therefore, the valve system allows pumping through only one of the two feed lines at a time.

In a phase change heat pipe loop, it is very important that the whole inside surface of the hot section be wetted with the working liquid. Such wetting can be achieved by flooding, or by spraying liquid to wet the inside surface of the tubes.

Figure 7:
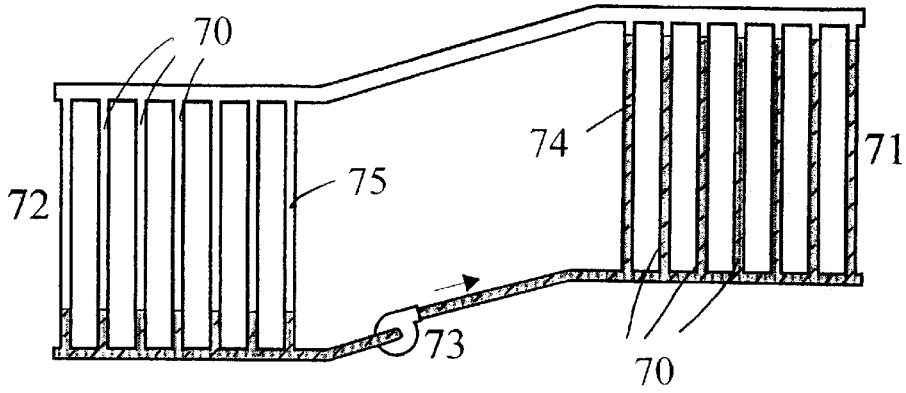
FIG. 7 is a side-view diagram of the flooding method of fluid pumping.
Figure 8:
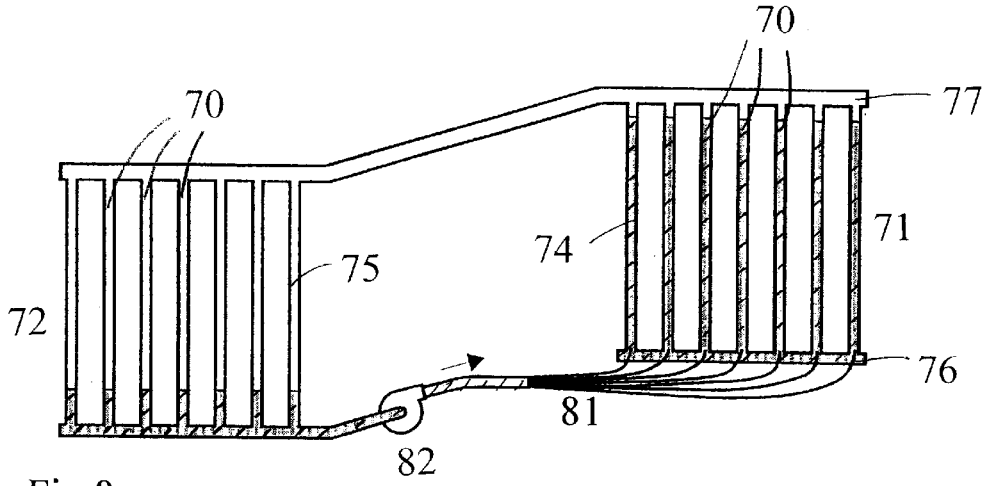
FIG. 8 is a side-view diagram of one embodiment of a distribution method of fluid pumping.
Figure 9:
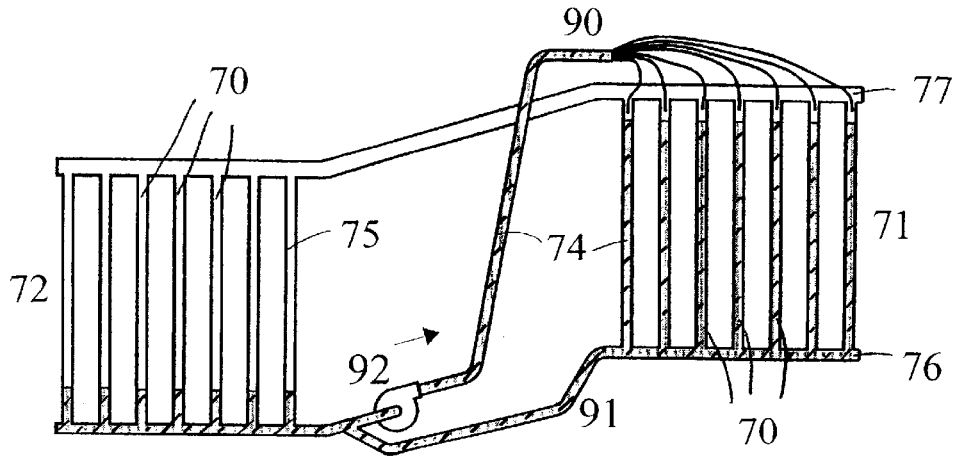
FIG. 9 is a side-view diagram of a second embodiment of a distribution method of fluid pumping.

FIG. 7 is a diagram of the flooding method of fluid pumping. The two sections of the loop heat pipe can be at the same level or not. FIGS. 7–9 illustrate that each of the heat pipe sections 71 and 72 is made of a plurality of tubes 70. Without pumping, the liquid 74 level in the two sections tends to equalize, leaving less inside room in the sections to either vaporize or condense, leading to diminished transfer capacity of the loop. For the loop to work with maximum efficiency, there must be one hot section 71 filled as much as possible with liquid 74 that vaporizes and one cold section 72 filled as much as possible with vapor 75 that condenses, so each entire section will either vaporize or condense. To achieve the effect of filling up one section with liquid 74 and leaving the other empty for vapor 75 condensation, pump 73 is used to push liquid 74 from the cold section 72 to raise the level of the liquid 74 in the hot section 71. The advantage of the flooding technique is that no distribution device is needed. However, a large amount of working fluid 74 is needed for flooding.

FIG. 8 is a diagram of one embodiment of a distribution method of fluid pumping. Aside from flooding, another method to ensure maximum vaporization is to fully wet the inside surface of the hot section 71 by pumping and spraying or otherwise wetting the working fluid 74 onto the inside surface of each tube 70. This method necessitates the use of distributor 81 intermediate pump 82 and the second heat pipe section 71; the bulk flow of liquid 74 is divided by distributor 81 to the different tubes 70 of hot section 71. Suitable distributors include devices such as a manifold, a distributor head, and a perforated pipe. This method may be used with much smaller amounts of working fluid 74. In the embodiment illustrated in FIG. 8, distributor 81 pumps or sprays the working liquid 74 from the bottom of the "hot" section 71.

FIG. 9 is a diagram of a second embodiment of a distribution method of fluid pumping, in which distributor 90 pumps or sprays the working liquid 74 from the top of the "hot" section 71. In this case, the liquid return line 91 will be connected to the cold section before the inlet of pump 92.

FIGS. 8 and 9 are illustrated with a distributor 81 or 90 feeding into the "hot" section 71 from the exterior of the heat pipe section 71 through a plurality of pipes, each pipe feeding into one of the plurality of tubes 70 of the section. It is contemplated that in an alternative embodiment, the distributor 81 or 90 comprises a pipe nestled coaxially within the liquid line 76 or vapor line 77 respectively, the pipe having perforations which spray or otherwise distribute working liquid 74 into the plurality of tubes 70 of the "hot" heat pipe section 71 from the interior of the liquid line 76 or vapor line 77 tubing. This embodiment greatly simplifies the manufacturing of the system.

Figure 10:
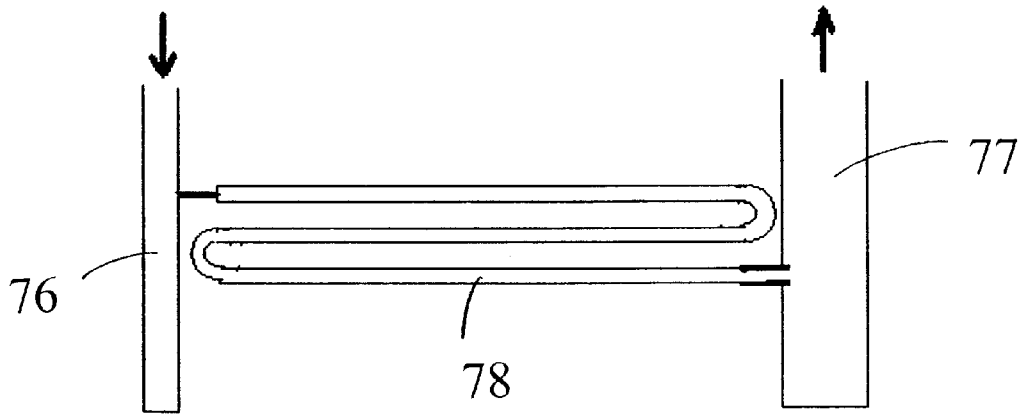
FIG. 10 is a side-view diagram of an alternate embodiment of a heat pipe tube.
Figure 11:
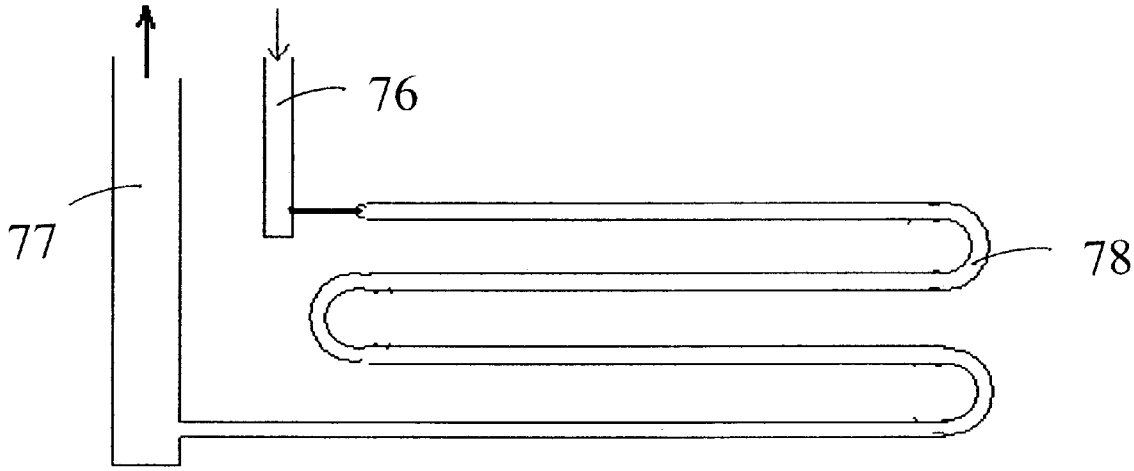
FIG. 11 is a side-view diagram of yet another embodiment of a heat pipe tube.

While the preceding examples are illustrated with the tubes 70 of the heat pipe sections positioned substantially vertically, it is contemplated that the tubes 70 may also be inclined or positioned substantially horizontally. Moreover, while each tube 70 may be a straight pipe, it is also contemplated that each tube 70 may have a serpentine configuration, as shown in FIGS. 10 and 11. FIGS. 10 and 11 show only one tube of one section of a heat pipe loop; therefore, FIGS. 10 and 11 represent only a partial view of a heat pipe loop taught in the preceding disclosure. As discussed above, it is to be understood that a pump is connected in the liquid line.

FIG. 10 is a diagram of an alternate embodiment of a heat pipe tube, positioned substantially horizontally and formed in a sinuous, serpentine configuration with one or more U-shaped bends. With a horizontal disposition of tubes 70 or 78, the cold and hot sections are generally above and below each other, rather than side-by-side as depicted in FIGS. 3–9. One advantage of a horizontal configuration is that access from the side of the machine allows an operator to more easily service the tubes 70 or 78. Another advantage is that when a finned heat pipe heat exchanger is used, the horizontal orientation of tubes 70 or 78 allows condensation water to more easily drain from the fins. Such a finned tube heat exchanger is described in U.S. Pat. No. 5,582,246 by Khanh Dinh, entitled "Finned Tube Heat Exchanger with Secondary Star Fins and Method for its Production," incorporated herein by reference.

While one serpentine tube 78 is shown, it is contemplated that more tubes 78 may be used and that each tube 78 may comprise more or fewer U-bend turns. Moreover, while serpentine tube 78 is shown generally horizontally, tube 78 may also be inclined or positioned generally vertically.

Heat transfer is generally proportional to the surface area of tubes 70 or 78, as well as the length and diameter. By forming each tube 78 in a serpentine shape, gains in length can be achieved for a set distance between liquid line 76 and vapor line 77 without increasing the number of joints between tube 78 and liquid line 76 or vapor line 77. This increases the ease of manufacture of the heat pipe loop.

FIG. 11 is a diagram of yet another embodiment of heat pipe tube 78. In this embodiment, liquid line 76 and vapor line 77 are disposed at the same end of the heat pipe loop. This increases ease of maintenance of the heat pipe loop by offering access to both lines on one convenient side.

Although the present invention has been described with reference to preferred embodiments, workers skilled in the art will recognize that changes may be made in form and detail without departing from the spirit and scope of the invention. For example, if a reversible pump is used, it is contemplated that a two way pump assisted heat pipe loop will require only one liquid line connected to the pump. Moreover, any of the heat pipe sections may use a finned heat exchanger configuration.

What is claimed is:

1. A heat pipe loop comprising:

a first heat pipe section having a first temperature and having a first plurality of tubes;

a second heat pipe section having a second temperature higher than the first temperature and having a second plurality of tubes;

a vapor line connecting an upper portion of the first heat pipe section with an upper portion of the second heat pipe section;

a liquid line connecting a lower portion of the first heat pipe section with a lower portion of the second heat pipe section;

a pump which pumps liquid from the first heat pipe section to the second heat pipe section through the liquid line; and a liquid distributor intermediate the pump and the second heat pipe section which sprays the liquid to wet an inside surface of each of the second plurality of tubes.

2. The heat pipe loop of claim 1 in which the first heat pipe section is a condenser and the second heat pipe section is an evaporator.

3. The heat pipe loop of claim 1 in which the first heat pipe section is disposed at a first elevation and the second heat pipe section is disposed at a second elevation higher than the first elevation.

4. The heat pipe loop of claim 1 in which the liquid distributor sprays the liquid from an tipper portion of the second plurality of tubes.

5. The heat pipe loop of claim 4 further comprising:

a liquid return line intermediate a lower portion of the second plurality of tubes and an inlet of the pump.

6. The heat pipe loop of claim 4 in which the liquid distributor comprises a perforated pipe disposed coaxially within the vapor line.

7. The heat pipe loop of claim 1 in which the liquid distributor sprays the liquid from a lower portion of the second plurality of tubes.

8. The heat pipe loop of claim 7 in which the liquid distributor comprises a perforated pipe disposed coaxially within the liquid line.

9. The heat pipe loop of claim 1 in which the first plurality of tubes are disposed substantially vertically; and the second plurality of tubes are disposed substantially vertically.

10. The heat pipe loop of claim 1 in which the first plurality of tubes are disposed substantially horizontally; and the second plurality of tubes are disposed substantially horizontally.

11. The heat pipe loop of claim 1 in which the second temperature is less than about 5° F. higher than the first temperature.

12. A heat pipe loop comprising:

a first heat pipe section having a first plurality of tubes;

a second heat pipe section having a second plurality of tubes;

a vapor line connecting an upper portion of the first heat pipe section with an upper portion of the second heat pipe section;

a liquid line connecting a lower portion of the first heat pipe section with a lower portion of the second heat pipe section;

a first pump which pumps liquid from one heat pipe section to the other heat pipe section through the liquid line; and a liquid distributor intermediate the pump and the second heat pipe section which sprays the liquid to wet an inside surface of each of the second plurality of tubes.

13. The heat pipe loop of claim 12 in which the liquid distributor is disposed coaxially within the vapor line.

* * * * *

UNITED STATES PATENT AND TRADEMARK OFFICE

CERTIFICATE OF CORRECTION

PATENT NO. : 6,745,830 B2
DATED : June 8, 2004
INVENTOR(S) : Khanh Dinh

It is certified that error appears in the above-identified patent and that said Letters Patent is hereby corrected as shown below:

Column 2,
Line 30, delete “heat-pipes”, insert -- heat pipes --
Line 53, delete “and/is”, insert -- and is --

Column 3,
Line 60, delete “level-or”, insert -- level or --

Column 6,
Line 63, delete “tipper”, insert -- upper --

Signed and Sealed this

Twenty-eighth Day of December, 2004

JON W. DUDAS
*Director of the United States Patent and Trademark Office*